US007884838B2

(12) United States Patent
Lee et al.

(10) Patent No.: US 7,884,838 B2
(45) Date of Patent: Feb. 8, 2011

(54) GAMMA ADJUSTING APPARATUS AND METHOD OF THE SAME

(75) Inventors: Hsin-Hung Lee, Fongshan (TW); Tung-Lin Hsieh, Jhongli (TW); Yung-Sheng Hsu, Kaohsiung (TW)

(73) Assignee: Quanta Computer Inc., Yao Yuan Shien (TW)

( * ) Notice: Subject to any disclaimer, the term of this patent is extended or adjusted under 35 U.S.C. 154(b) by 975 days.

(21) Appl. No.: 11/716,111

(22) Filed: Mar. 8, 2007

(65) Prior Publication Data

US 2007/0247407 A1 Oct. 25, 2007

(30) Foreign Application Priority Data

Apr. 19, 2006 (TW) ..... 95113873 A

(51) Int. Cl.
*G09G 5/10* (2006.01)

(52) U.S. Cl. ..... 345/690

(58) Field of Classification Search ..... 345/690
See application file for complete search history.

(56) References Cited

U.S. PATENT DOCUMENTS 5,473,373 A * 12/1995 Hwung et al. ..... 348/254
5,870,503 A * 2/1999 Kumashiro ..... 382/252
6,232,954 B1 * 5/2001 Rozzi ..... 345/601
6,342,951 B1 * 1/2002 Eschbach et al. ..... 358/1.9
6,753,831 B1 * 6/2004 Ide et al. ..... 345/60
6,987,499 B2 * 1/2006 Yamaguchi et al. ..... 345/89
7,030,846 B2 * 4/2006 Lee et al. ..... 345/89
7,046,223 B2 5/2006 Hashimoto
7,075,560 B2 7/2006 Ohe et al.
7,477,227 B2 1/2009 Hashimoto
7,502,038 B2 * 3/2009 Yasuda et al. ..... 345/690

(Continued)

FOREIGN PATENT DOCUMENTS

TW 519614 2/2003

(Continued)

OTHER PUBLICATIONS

English language translation of abstract of TW 519614 (published Feb. 1, 2003).

(Continued)

*Primary Examiner*—Bipin Shalwala
*Assistant Examiner*—Dorothy Webb
(74) *Attorney, Agent, or Firm*—Thomas, Kayden, Horstemeyer & Risley

(57) ABSTRACT

The invention discloses a gamma adjusting apparatus for adjusting the gray level of each pixel of an image signal. The gamma adjusting apparatus includes a measuring unit, a first processing unit, a second processing unit, and a third processing unit. The measuring unit measures the lightness of N reference gray levels. The first processing unit normalizes the lightness of the N reference gray levels to generate N normalized reference values. The second processing unit compares the N normalized reference values with a standard gamma curve to generate N adjusted gray levels. According to the N reference gray levels and the N adjusted gray levels, the third processing unit sets an adjusting rule. According to the adjusting rule, the gamma adjusting apparatus is capable of adjusting the gray level of each pixel of the image signal to comply with the standard gamma curve.

8 Claims, 5 Drawing Sheets

U.S. PATENT DOCUMENTS

| | | | | |
|---|---|---|---|---|
| 7,746,304 | B2 * | 6/2010 | Lee et al. | 345/89 |
| 2002/0093475 | A1 * | 7/2002 | Hashimoto | 345/87 |
| 2003/0125892 | A1 * | 7/2003 | Edge | 702/107 |
| 2004/0196250 | A1 * | 10/2004 | Mehrotra et al. | 345/102 |
| 2005/0111046 | A1 * | 5/2005 | Kurumisawa et al. | 358/3.06 |
| 2006/0182366 | A1 * | 8/2006 | Hsu et al. | 382/274 |

FOREIGN PATENT DOCUMENTS

| | | |
|---|---|---|
| TW | 559761 | 11/2003 |
| TW | 571278 | 1/2004 |
| WO | WO 2005/041165 | 5/2005 |
| WO | WO 2005041165 A1 * | 5/2005 |

OTHER PUBLICATIONS

English language translation of abstract of TW 559761 (published Nov. 1, 2003).

English language translation of abstract of TW 571278 (published Jan. 11, 2004).

English language translation of abstract of WO 2005/041165 (published May 6, 2005).

* cited by examiner

GAMMA ADJUSTING APPARATUS AND METHOD OF THE SAME

BACKGROUND OF THE INVENTION

1. Field of the Invention

The invention relates to a gamma adjusting apparatus and method, and more particularly, to a gamma adjusting apparatus and method capable of effectively improving the gamma characteristic of a flat panel display (FPD).

2. Description of the Prior Art

Because the fluorescent characteristic of conventional cathode ray tube (CRT) complies with gamma 2.2, the image signal has to comply with gamma 0.45 for display, and then the displayed image will comply with gamma 1.0 consequently. Nowadays, since the image signal inputted to the FPD complies with gamma 0.45, the gamma characteristic of the FPD has to be converted into gamma 2.2 to match up with the image signal.

In general, it is quite important to adjust the gamma value to be a constant, so that the colors displayed on the screen can maintain consistency. Unstable gamma value not only cannot guarantee consistent colors between equipment and equipment but also cannot maintain stable colors. Therefore, for a good screen, the gamma value should be maintained as a constant, and the screen should be stable enough to maintain the gamma value. Accordingly, the colors displayed on the screen will maintain consistency.

For liquid crystal display (LCD) panel, the gamma value may be influenced by resistance, back light component, the fabricating process, and so on. The scope of the invention is to provide a gamma adjusting apparatus and method for improving voltage difference, so as to solve the aforementioned problems.

SUMMARY OF THE INVENTION

A scope of the invention is to provide a gamma adjusting apparatus and method for adjusting the gamma characteristic of the panel without changing the resistance of the hardware.

According to a preferred embodiment, the gamma adjusting apparatus of the invention is used for adjusting the gray level of each pixel of an image signal. The gamma adjusting apparatus comprises a measuring unit, a first processing unit, a second processing unit, and a third processing unit.

The measuring unit is used for measuring lightness of N reference gray levels, wherein N is a natural number. The first processing unit is used for normalizing the lightness of the N reference gray levels to generate N normalized reference values corresponding to the N reference gray levels. The second processing unit is used for comparing the N normalized reference values with a standard gamma curve to generate N adjusting gray levels corresponding to the N reference gray levels. The third processing unit is used for setting an adjusting rule according to the N reference gray levels and the N adjusting gray levels. When the pixels of the image signal are inputted into the gamma adjusting apparatus, the gamma adjusting apparatus will adjust the gray level of each pixel to comply with the standard gamma curve according to the adjusting rule.

Therefore, the gamma adjusting apparatus of the invention only has to measure the lightness of specific reference gray levels and then compare those reference gray levels with the standard gamma curve, such that the image signal can be adjusted to comply with gamma characteristic of the panel. Consequently, the adjusting rate of gamma is improved.

The advantage and spirit of the invention may be understood by the following recitations together with the appended drawings.

BRIEF DESCRIPTION OF THE APPENDED DRAWINGS

DETAILED DESCRIPTION OF THE INVENTION

Figure 1:
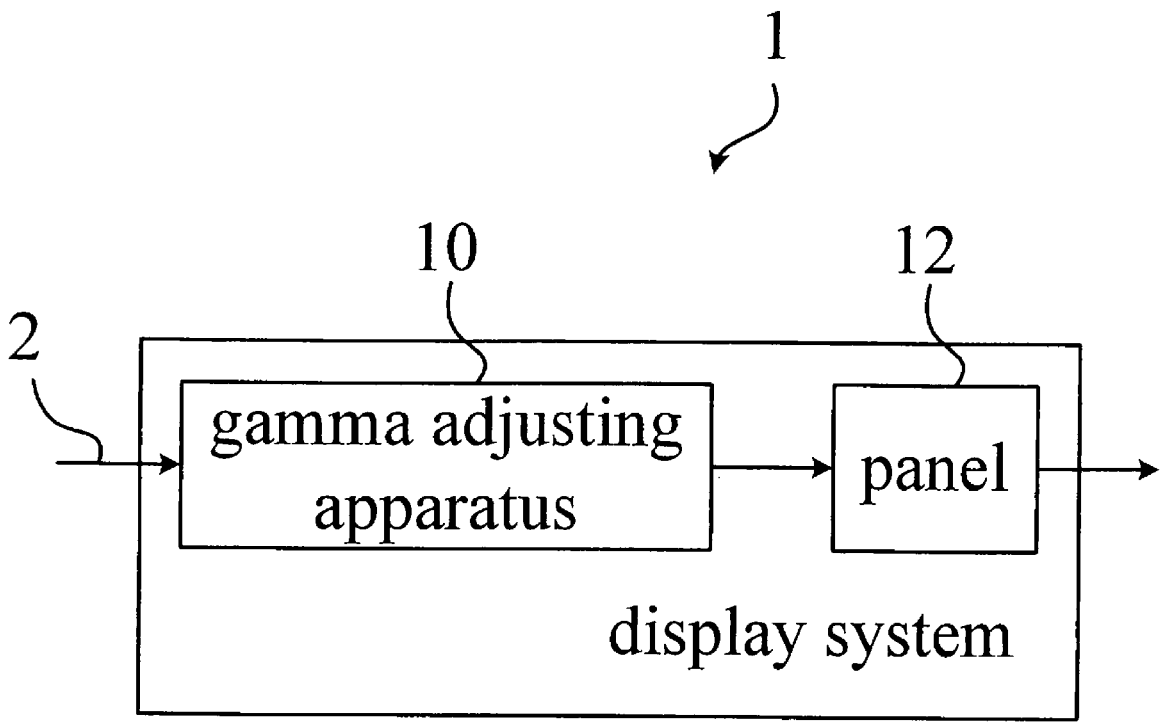
FIG. 1 is a functional block diagram illustrating a display system.
Figure 2:
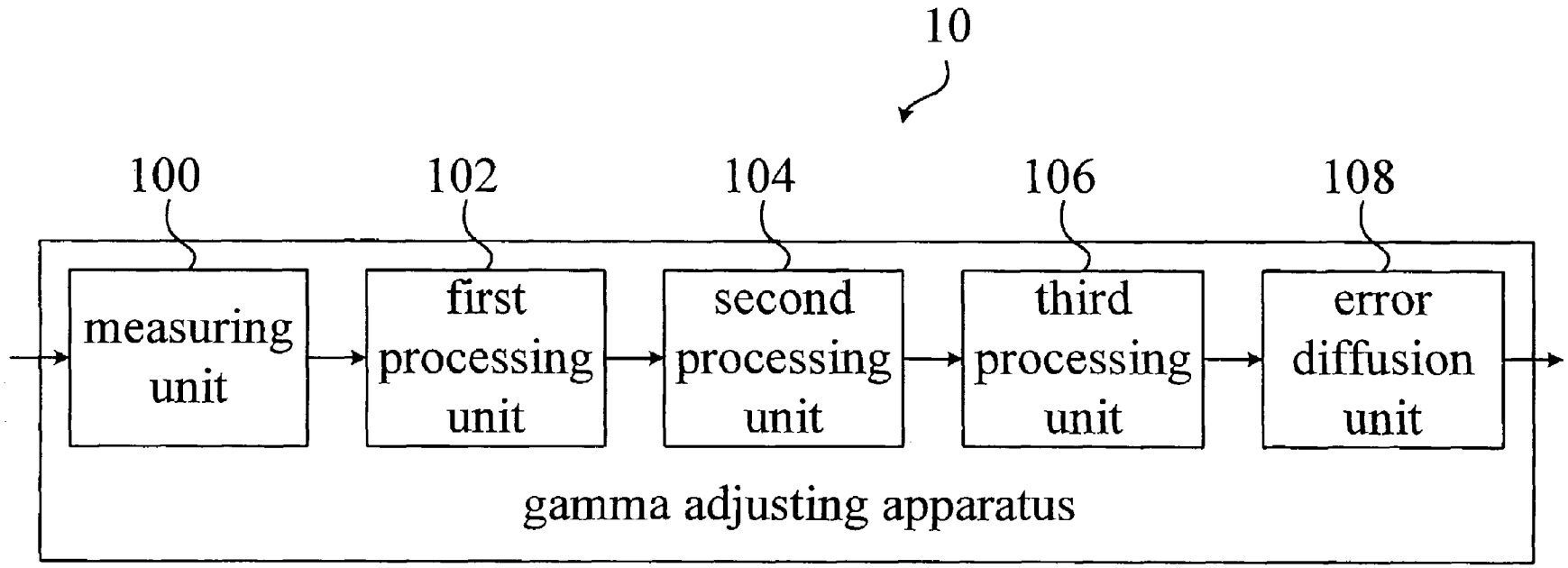
FIG. 2 is a functional block diagram illustrating a gamma adjusting apparatus according to a preferred embodiment of the invention.

Referring to FIG. 1 and FIG. 2, FIG. 1 is a functional block diagram illustrating a display system 1, and FIG. 2 is a functional block diagram illustrating a gamma adjusting apparatus 10 according to a preferred embodiment of the invention. The invention provides the gamma adjusting apparatus 10 for adjusting the gray level of each pixel of an image signal 2 within the display system 1 to comply with gamma characteristic of the panel 12. In this embodiment, the display system 1 can be an FPD, such as plasma display panel (PDP), LCD, and so on. Take PDP as an example, the drive ICs can be divided into data IC and gate IC, wherein the gate IC is used for checking whether the signals on the PDP is on/off, and the data IC is used for inputting related image data.

As shown in FIG. 2, the gamma adjusting apparatus 10 comprises a measuring unit 100, a first processing unit 102, a second processing unit 104, a third processing unit 106, and an error diffusion unit 108.

Figure 3:
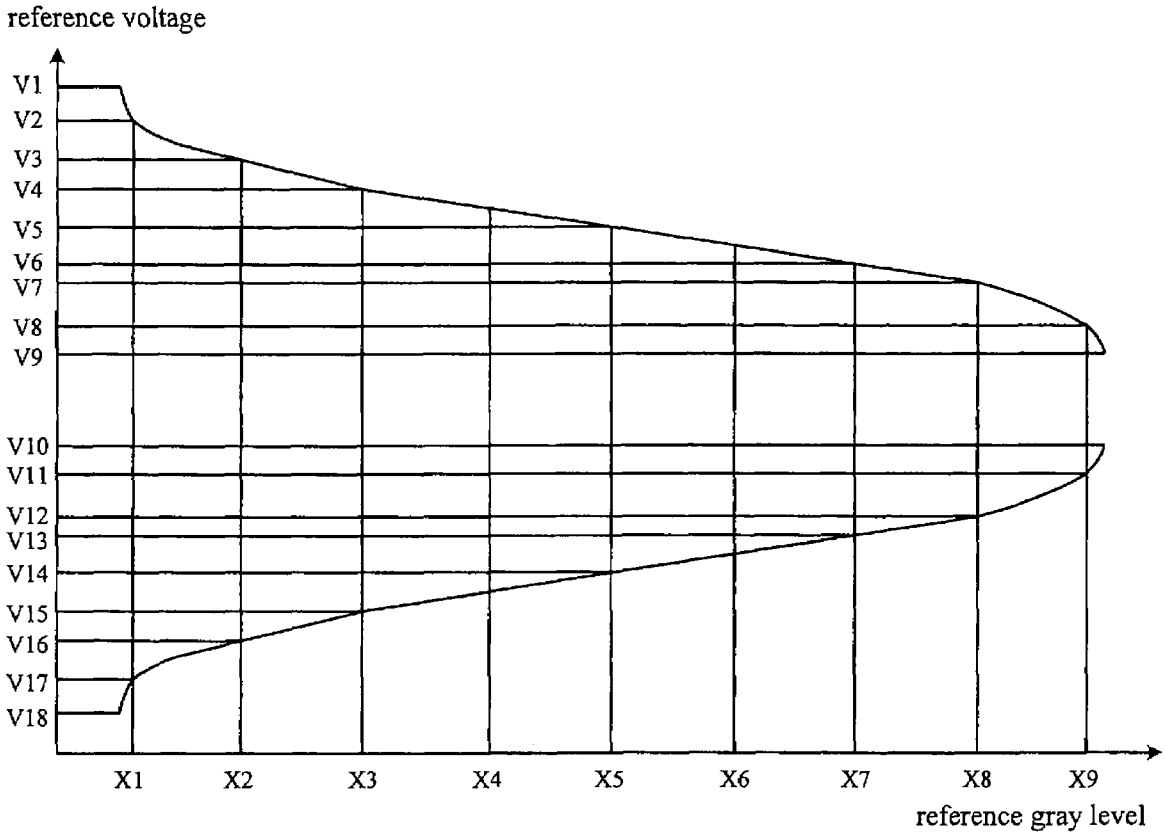
FIG. 3 illustrates the reference gray levels defined by Novatek.

The measuring unit 100 is used for measuring the lightness of N reference gray levels, wherein N is a natural number. The reference gray levels are defined by the data IC. Referring to FIG. 3, FIG. 3 illustrates the reference gray levels defined by Novatek. As shown in FIG. 3, X1-X9 represent the reference gray levels, and each of the reference gray levels X1-X9 respectively corresponds to one of the reference voltage V1-V9 with positive-polarity and one of the reference voltage V10-V18 with negative-polarity. The invention will be depicted in the following in accordance with the reference gray levels defined by Novatek, but not limited to that manner.

In this embodiment, the lightness of each reference gray level X1-X9 measured by the measuring unit 100 is listed in table 1 as follows.

TABLE 1

| Reference gray level | Lightness |
|---|---|
| 1 (X1) | 0.53 (L1) |
| 32 (X2) | 7.48 (L2) |
| 64 (X3) | 29.42 (L3) |
| 96 (X4) | 75.21 (L4) |
| 128 (X5) | 135 (L5) |
| 160 (X6) | 214.1 (L6) |
| 192 (X7) | 310.2 (L7) |
| 224 (X8) | 422.8 (L8) |
| 254 (X9) | 548.3 (L9) |

In this embodiment, the first processing unit 102 is coupled to the measuring unit 100. According to equation 1 below, the first processing unit 102 is used for normalizing the lightness of the reference gray levels X1-X9 to generate nine normalized reference values corresponding to the reference gray levels X1-X9.

$$\text{Nor_Ln} = \frac{Ln - L1}{L9 - L1}. \qquad \text{Equation 1}$$

In equation 1, Ln represents the lightness of the $n^{th}$ reference gray level, Nor_Ln represents the $n^{th}$ normalized reference value. The nine normalized reference values corresponding to the reference gray levels X1-X9 are listed in table 2 as follows.

TABLE 2

| Reference gray level | Lightness | Normalized reference value |
|---|---|---|
| 1 (X1) | 0.53 (L1) | 0 (Nor_L1) |
| 32 (X2) | 7.48 (L2) | 0.012688 (Nor_L2) |
| 64 (X3) | 29.42 (L3) | 0.052741 (Nor_L3) |
| 96 (X4) | 75.21 (L4) | 0.136335 (Nor_L4) |
| 128 (X5) | 135 (L5) | 0.245486 (Nor_L5) |
| 160 (X6) | 214.1 (L6) | 0.38989 (Nor_L6) |
| 192 (X7) | 310.2 (L7) | 0.565329 (Nor_L7) |
| 224 (X8) | 422.8 (L8) | 0.770889 (Nor_L8) |
| 254 (X9) | 548.3 (L9) | 1 (Nor_L9) |

In this embodiment, the second processing unit 104 is coupled to the first processing unit 102 and is used for comparing the nine normalized reference values with a standard gamma curve to generate nine adjusting gray levels corresponding to the reference gray levels X1-X9. The standard gamma curve can be generated by equation 2 as follows.

$$\left(\frac{x}{255}\right)^{\delta}. \qquad \text{Equation 2}$$

For example, if the gamma characteristic of the panel 12 is gamma 2.2, δ in equation 2 will be equal to 2.2. In equation 2, x represents any of the gray levels. The invention will be depicted in the following in accordance with gamma 2.2, but not limited to that manner. For example, if the normalized reference value corresponding to the reference gray level 32 (X2) is equal to 0.012688 (Nor_L2), the corresponding value of gamma 2.2 is equal to 0.012664 (x=35); if the normalized reference value corresponding to the reference gray level 64 (X3) is equal to 0.052741 (Nor_L3), the corresponding value of gamma 2.2 is equal to 0.052842 (x=67); and so on. The nine adjusting gray levels (Y1-Y9) corresponding to the reference gray levels X1-X9 are listed in table 3 as follows.

TABLE 3

| Reference gray level | Adjusting gray level |
|---|---|
| 1 (X1) | 1 (Y1) |
| 32 (X2) | 35 (Y2) |
| 64 (X3) | 67 (Y3) |
| 96 (X4) | 103 (Y4) |
| 128 (X5) | 135 (Y5) |
| 160 (X6) | 166 (Y6) |
| 192 (X7) | 197 (Y7) |
| 224 (X8) | 227 (Y8) |
| 254 (X9) | 254 (Y9) |

In this embodiment, the third processing unit 106 is coupled to the second processing unit 104. According to the aforesaid nine reference gray levels (X1-X9) and adjusting gray levels (Y1-Y9), the third processing unit 106 is used for setting an adjusting rule. The adjusting rule comprises the following formulae:

when $G_{in}$ is equal to 0 or 255, $G_{out}$ is equal to $G_{in}$; and when $G_{in}$ is larger than or equal to $Y_i$ and $G_{in}$ is smaller than $Y_{i+1}$, $$G_{out} = (G_{in} - Y_i) * \left(\frac{X_{i+1} - X_i}{Y_{i+1} - Y_i}\right) + Y_i,$$

wherein i is an integer index between 1 and N−1.

In the aforesaid adjusting rule, $G_{in}$ represents the gray level of each pixel, $G_{out}$ represents the adjusted gray level of each pixel, $X_i$ represents the $i^{th}$ reference gray level of the nine reference gray levels (X1-X9), and $Y_i$ represents the $i^{th}$ adjusting gray level of the nine adjusting gray levels (Y1-Y9). When the image signal 2 is inputted into the gamma adjusting apparatus 10 of the display system 1, the gamma adjusting apparatus 10 will adjust the gray level $G_{in}$ of each pixel of the image signal 2 to the gray level $G_{out}$ complying with the gamma curve (e.g. gamma 2.2 in this embodiment) according to the aforesaid adjusting rule.

For example, if the gray level $G_{in}$ of one pixel is equal to 35, the adjusted gray level $G_{out}$ is equal to 32. Since the gamma characteristic of the panel 12 is gamma 2.2, the adjusted gray level ($G_{out}$=32) can be accurately displayed on the panel 12 by the lightness of gray level 35.

In another preferred embodiment of the invention, a look-up table can be set based on the aforesaid adjusting rule. The look-up table records a plurality of input gray levels $G_{in}$ and a plurality of output gray levels $G_{out}$, and each of the output gray levels $G_{out}$ respectively corresponds to one of the input gray levels $G_{in}$, as shown in the following table 4.

TABLE 4

| Output gray level $G_{out}$ | Input gray level $G_{in}$ |
|---|---|
| 0 | 0 |
| 1 | 1 |
| 1.911765 | 2 |
| .823529 | 3 |
| . . . | . . . |
| 32 | 35 |
| 36 | 36 |
| . . . | . . . |
| 64 | 67 |
| 67.888889 | 68 |
| . . . | . . . |
| 255 | 255 |

Finally, after the image signal 2 is adjusted, the error diffusion unit 108, coupled to the third processing unit 106, diffuses variation error (decimal) of each pixel. Accordingly, the adjusted image signal 2 can be accurately displayed on the panel 12 by the lightness complying with the gamma characteristic of the panel 12.

Figure 4:
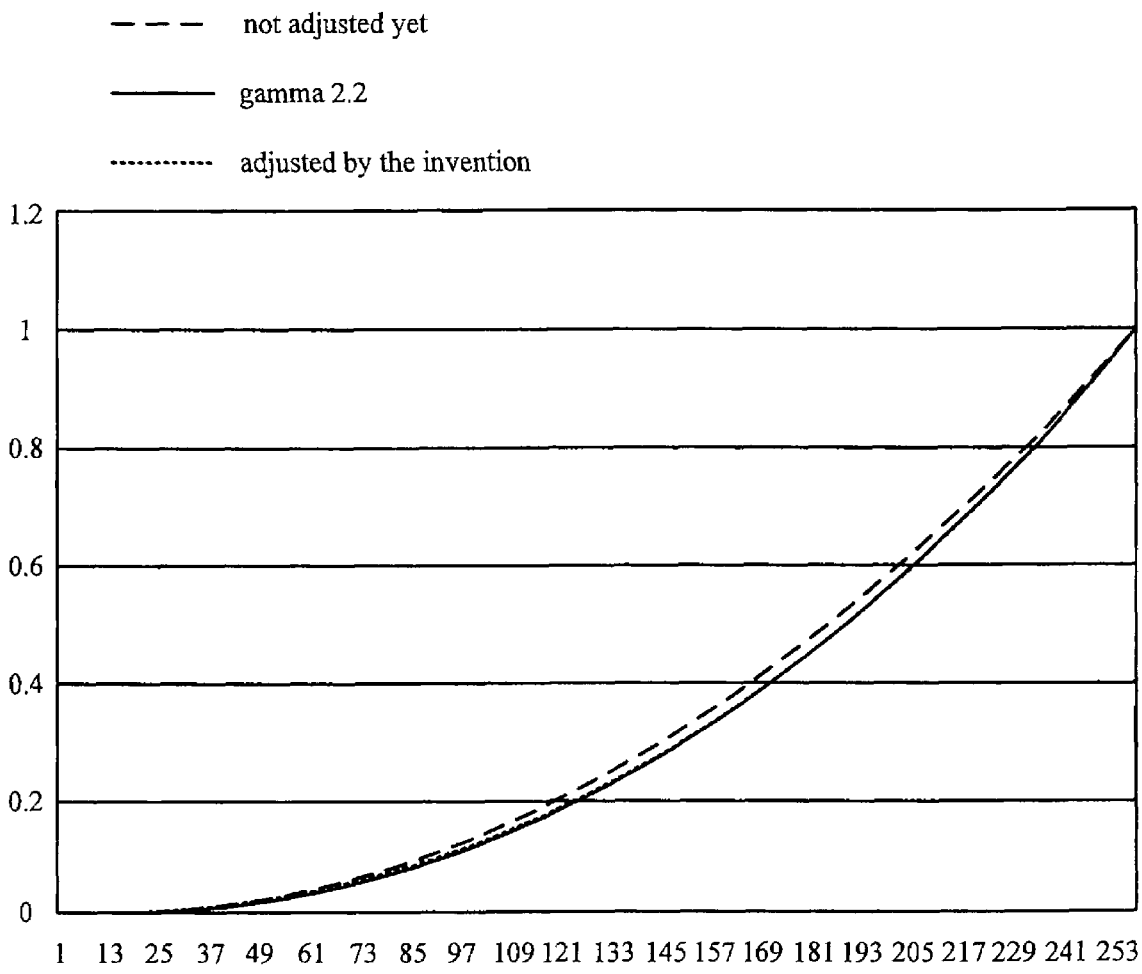
FIG. 4 illustrates the result after the image signal is adjusted by the invention.

Referring to FIG. 4, FIG. 4 illustrates the result after the image signal is adjusted by the invention. As shown in FIG. 4, it is obvious that after being adjusted by the invention, the image signal almost completely complies with the standard gamma 2.2 curve.

Figure 5:
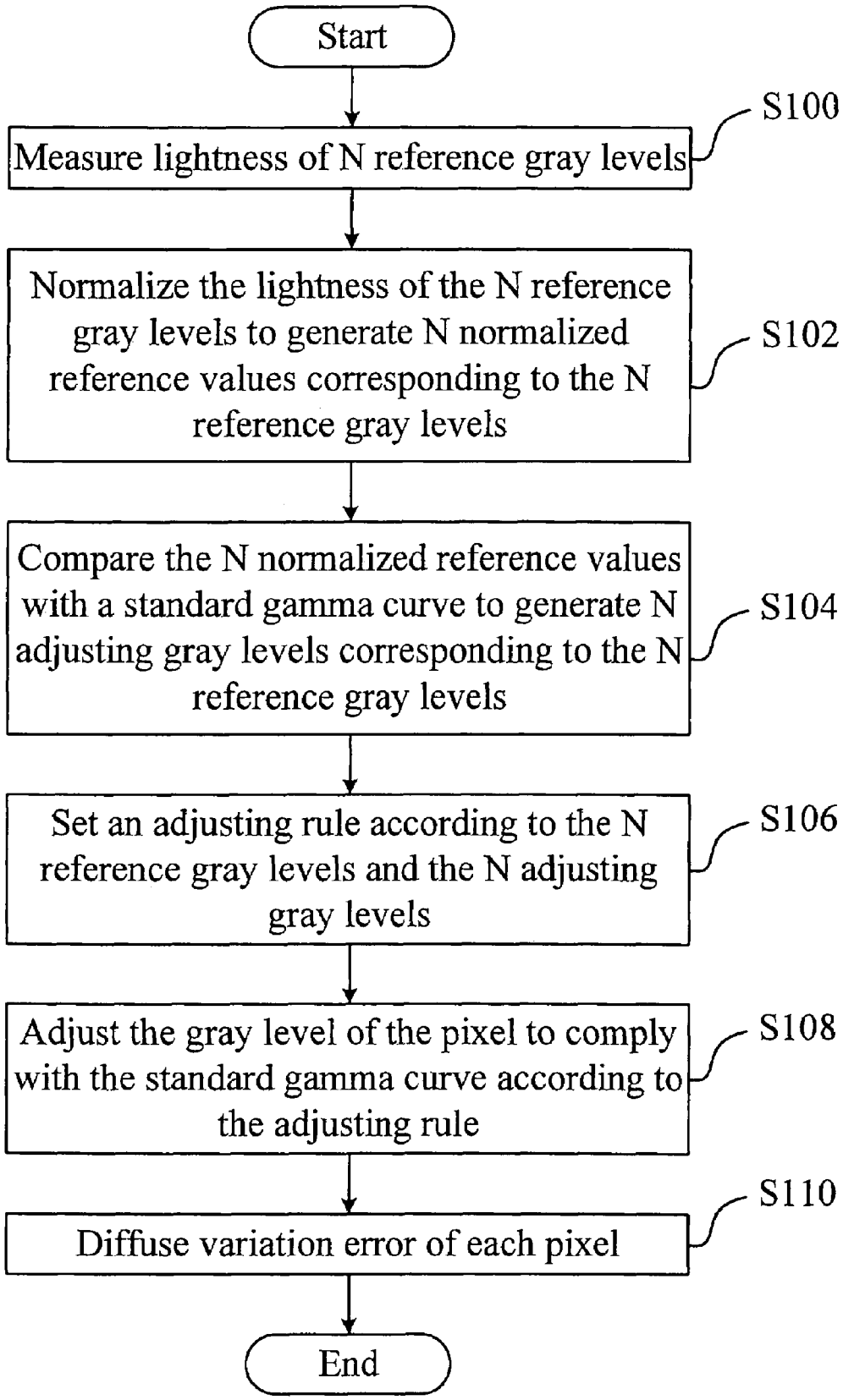
FIG. 5 is a flowchart showing the gamma adjusting method according to a preferred embodiment of the invention.

Referring to FIG. 5, FIG. 5 is a flowchart showing the gamma adjusting method according to a preferred embodiment of the invention. Referring to FIG. 1 to FIG. 3, the method of the invention is used for adjusting the gray level of each pixel of the image signal 2 within the display system 1 to comply with the gamma characteristic of the panel 12. According to the aforesaid preferred embodiment, the gamma adjusting method of the invention comprises the following steps.

At the start, step S100 is performed to measure the lightness of N reference gray levels (N is equal to 9 defined by Novatek). Afterward, step S102 is performed to normalize the lightness of the N reference gray levels to generate N normalized reference values corresponding to the N reference gray levels. Step S104 is then performed to compare the N normalized reference values with a standard gamma curve to generate N adjusting gray levels corresponding to the N reference gray levels. Step S106 is then performed to set an adjusting rule according to the N reference gray levels and the N adjusting gray levels. Step S108 is then performed to adjust the gray level of the pixel to comply with the standard gamma curve according to the adjusting rule. Finally, step S110 is performed to diffuse variation error (decimal) of each pixel.

Compared to the prior art, the gamma adjusting apparatus and method of the invention only have to measure the lightness of specific reference gray levels defined by the data IC and then compare those reference gray levels with the standard gamma curve (in light of the gamma characteristic of the panel), such that the image signal can be adjusted to comply with the gamma characteristic of the panel. Consequently, the adjusting rate of gamma is improved.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A gamma adjusting apparatus for adjusting a gray level of a pixel, the apparatus comprising:

a measuring unit for measuring the lightness of N reference gray levels, N being a natural number;

a first processing unit, coupled to the measuring unit, for normalizing the lightness of the N reference gray levels to generate N normalized reference values corresponding to the N reference gray levels;

a second processing unit, coupled to the first processing unit, for comparing the N normalized reference values with a standard gamma curve to generate N adjusting gray levels corresponding to the N reference gray levels; and a third processing unit, coupled to the second processing unit, for setting an adjusting rule according to the N reference gray levels and the N adjusting gray levels;

wherein when the pixel is inputted into the gamma adjusting apparatus, the gamma adjusting apparatus adjusts the gray level of the pixel to comply with the standard gamma curve according to the adjusting rule;

wherein the adjusting rule comprises the following formulae:

when $G_{in}$ is equal to 0 or 255, $G_{out}$ is equal to $G_{in}$; and when $G_{in}$ is larger than or equal to $Y_i$ and $G_{in}$ is smaller than $Y_{i+1}$, $$G_{out} = (G_{in} - Y_i) * \left(\frac{X_{i+1} - X_i}{Y_{i+1} - Y_i}\right) + Y_i,$$

i is an integer index between 1 and N−1;

wherein $G_{in}$ represents the gray level of the pixel $G_{out}$ represents the adjusted gray level of the pixel $X_i$ represents the $i^{th}$ reference gray level of the N reference gray levels, and $Y_i$ represents the $i^{th}$ adjusting gray level of the N adjusting gray levels.

2. The apparatus of claim 1, wherein the adjusting rule is a look-up table recording a plurality of input gray levels and a plurality of output gray levels, each of the output gray levels respectively corresponds to one of the input gray levels, the gray level of the pixel belongs to the input gray levels, and the adjusted gray level of the pixel belongs to the output gray levels.

3. The apparatus of claim 1, further comprising an error diffusion unit, coupled to the third processing unit, for diffusing the variation error after the pixel is adjusted.

4. The apparatus of claim 1, wherein the N reference gray levels are defined by a data integrated circuit (IC).

5. A gamma adjusting method for adjusting a gray level of a pixel, the method comprising steps of:

(a) measuring the lightness of N reference gray levels, N being a natural number;

(b) normalizing the lightness of the N reference gray levels to generate N normalized reference values corresponding to the N reference gray levels;

(c) comparing the N normalized reference values with a standard gamma curve to generate N adjusting gray levels corresponding to the N reference gray levels; and (d) setting an adjusting rule according to the N reference gray levels and the N adjusting gray levels;

(e) adjusting the gray level of the pixel to comply with the standard gamma curve according to the adjusting rule;

wherein the adjusting rule comprises the following formulae:

when $G_{in}$ is equal to 0 or 255, $G_{out}$ is equal to $G_{in}$; and when $G_{in}$ is larger than or equal to $Y_i$ and $G_{in}$ is smaller than $Y_{i+1}$, $$G_{out} = (G_{in} - Y_i) * \left(\frac{X_{i+1} - X_i}{Y_{i+1} - Y_i}\right) + Y_i,$$

i is an integer index between 1 and N−1;

wherein $G_{in}$ represents the gray level of the pixel, $G_{out}$ represents the adjusted gray level of the pixel, $X_i$ represents the $i^{th}$ reference gray level of the N reference gray levels, and $Y_i$ represents the $i^{th}$ adjusting pray level of the N adjusting pray levels.

6. The method of claim 5, wherein the adjusting rule is a look-up table recording a plurality of input gray levels and a plurality of output gray levels, each of the output gray levels respectively corresponds to one of the input gray levels, the gray level of the pixel belongs to the input gray levels, and the adjusted gray level of the pixel belongs to the output gray levels.

7. The method of claim 5, further comprising step of:

(f) diffusing the variation error after the pixel is adjusted.

8. The method of claim 5, wherein the N reference gray levels are defined by a data integrated circuit (IC).

* * * * *